US007962072B2

(12) United States Patent
Li

(10) Patent No.: US 7,962,072 B2
(45) Date of Patent: Jun. 14, 2011

(54) TONER CARTRIDGE HAVING LOCKING MECHANISM FOR PREVENTING LEAKAGE OF TONER

(75) Inventor: Kuan-Tung Li, Taichung County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 875 days.

(21) Appl. No.: 11/738,614

(22) Filed: Apr. 23, 2007

(65) Prior Publication Data

US 2008/0131170 A1 Jun. 5, 2008

(51) Int. Cl.
*G03G 15/08* (2006.01)
*G03G 21/16* (2006.01)

(52) U.S. Cl. ..... 399/262; 399/106; 399/111; 399/258; 399/260

(58) Field of Classification Search ..... 399/106, 399/110, 119, 258, 260, 262, 263
See application file for complete search history.

(56) References Cited

U.S. PATENT DOCUMENTS 5,128,724 A * 7/1992 Hayashi et al. ..... 399/119
5,822,663 A * 10/1998 Ichikawa et al. ..... 399/262
5,862,441 A * 1/1999 Ohata ..... 399/119
6,128,453 A * 10/2000 Ban et al. ..... 399/106
6,259,874 B1 * 7/2001 Murakami et al. ..... 399/120
6,542,709 B1 * 4/2003 Wang et al. ..... 399/263
6,968,139 B2 * 11/2005 Ban et al. ..... 399/106
7,116,925 B2 * 10/2006 Yamaguchi ..... 399/111
7,505,716 B2 * 3/2009 Park ..... 399/258
7,720,417 B2 * 5/2010 Taguchi et al. ..... 399/258
2003/0219284 A1 * 11/2003 Ishiguro et al. ..... 399/258

* cited by examiner

*Primary Examiner* — David M Gray
*Assistant Examiner* — Francis Gray
(74) *Attorney, Agent, or Firm* — Browdy and Neimark, PLLC

(57) ABSTRACT

A toner cartridge includes a casing provided at a bottom side thereof with an outlet, a sliding member slidably mounted on the casing, and a retaining member pivotally mounted on the casing. The sliding member is movable relative to the casing between a first position where the outlet is closed by the sliding member and a second position where the outlet is opened. The retaining member is pivotable relative to the casing between a third position where the retaining member is engaged with the sliding member to lock the sliding member at the first position, and a forth position where the retaining member is disengaged from the sliding member such that the sliding member is moveable to the second position to open the outlet. The toner cartridge has the advantage of preventing leakage of toner due to unintentional movement of the sliding member.

10 Claims, 5 Drawing Sheets

TONER CARTRIDGE HAVING LOCKING MECHANISM FOR PREVENTING LEAKAGE OF TONER

BACKGROUND OF THE INVENTION

1. Field of the Invention

The present invention relates generally to a toner cartridge and more specifically, to a toner cartridge that has a locking mechanism to effectively prevent leakage of toner.

2. Description of the Related Art

U.S. Pat. No. 6,542,709 discloses a toner cartridge including a casing for accommodation of toner, a guiding groove, which is formed on a bottom side of the casing and provided with a tube extending along an axial direction thereof, and a cover, which seals a distal end of the tube and has an outlet on a bottom side thereof for output of the toner. As shown in FIG. 3 and FIG. 5 of the aforesaid patent, the toner cartridge further has a sliding member provided with a barrel portion mounted on the cover and the tube, and a positioning block coupled with a positioning mechanism of a photocopier. Thus, the sliding member can be driven to move by the positioning mechanism through the positioning block. When the sliding member moves rightward, the outlet is opened. On the contrary, when the sliding member moves leftward, the outlet is closed.

When the toner cartridge is not in use or is in carrying, the sliding member may be unintentionally touched and driven by an external force to move rightward, resulting in leakage of the toner as the outlet is opened. Besides, when the toner cartridge is inserted into the photocopier, the sliding member may be also driven to move by the friction between the sliding member and a housing of the photocopier. In order to prevent this situation, the size of the sliding member or the size of the casing has to be especially designed so as to enhance the friction between the sliding member and the casing, such that the sliding member won't be easily driven to move relative to the casing by an external force. However, the larger the friction between the sliding member and the casing is provided, the harder the sliding member can be driven by the positioning mechanism to move relative to the casing, resulting in that the sliding member may not be smoothly actuated. Therefore, it is a need to provide an improved toner cartridge.

SUMMARY OF THE INVENTION

The present invention has been accomplished in view of the above noted circumstances. It is therefore one objective of the present invention to provide a toner cartridge, which has a locking mechanism capable of preventing leakage of toner effectively.

It is another objective of the present invention to provide a toner cartridge, which can be smoothly operated.

To achieve these objectives of the present invention, the toner cartridge comprises a casing provided at a bottom side thereof with an outlet, a sliding member slidably mounted on the bottom side of the casing, and a retaining member pivotally mounted on the casing. The sliding member is movable relative to the casing between a first position where the outlet is closed by the sliding member and a second position where the outlet is opened. The retaining member is pivotable relative to the casing between a third position where the retaining member is engaged with the sliding member to lock the sliding member at the first position, and a forth position where the retaining member is disengaged from the sliding member such that the sliding member is moveable to the second position to open the outlet. Therefore, the toner cartridge provided by the present invention has the advantage of preventing leakage of toner due to unintentional movement of the sliding member.

In an embodiment, the casing may include a main body, a guiding groove formed on a bottom side of the main body, and a tube extending from the guiding groove and having a bottom side on which the outlet is formed. The sliding member may include a barrel sleeved onto the tube of the casing, and an arc plate extending from the barrel and abutted against a periphery of the guiding groove of the casing. The toner cartridge may include a spring member for holding the retaining member at the third position.

In another embodiment, the retaining member may include an elastic arm having a distal end stopped against the casing for holding the retaining member at the third position.

By means of the aforesaid design, the disclosed embodiments of the toner cartridge have the advantage of preventing leakage of toner due to unintentional movement of the sliding member.

Further scope of applicability of the present invention will become apparent from the detailed description given hereinafter. However, it should be understood that the detailed description and specific examples, while indicating exemplary embodiments of the invention, are given by way of illustration only, since various changes and modifications within the spirit and scope of the invention will become apparent to those skilled in the art from this detailed description.

BRIEF DESCRIPTION OF THE DRAWINGS

The disclosed exemplary embodiments will become more fully understood from the detailed description given herein below and the accompanying drawings which are given by way of illustration only, and thus are not limitative of the present invention, and wherein.

DETAILED DESCRIPTION OF THE INVENTION

Figure 1:
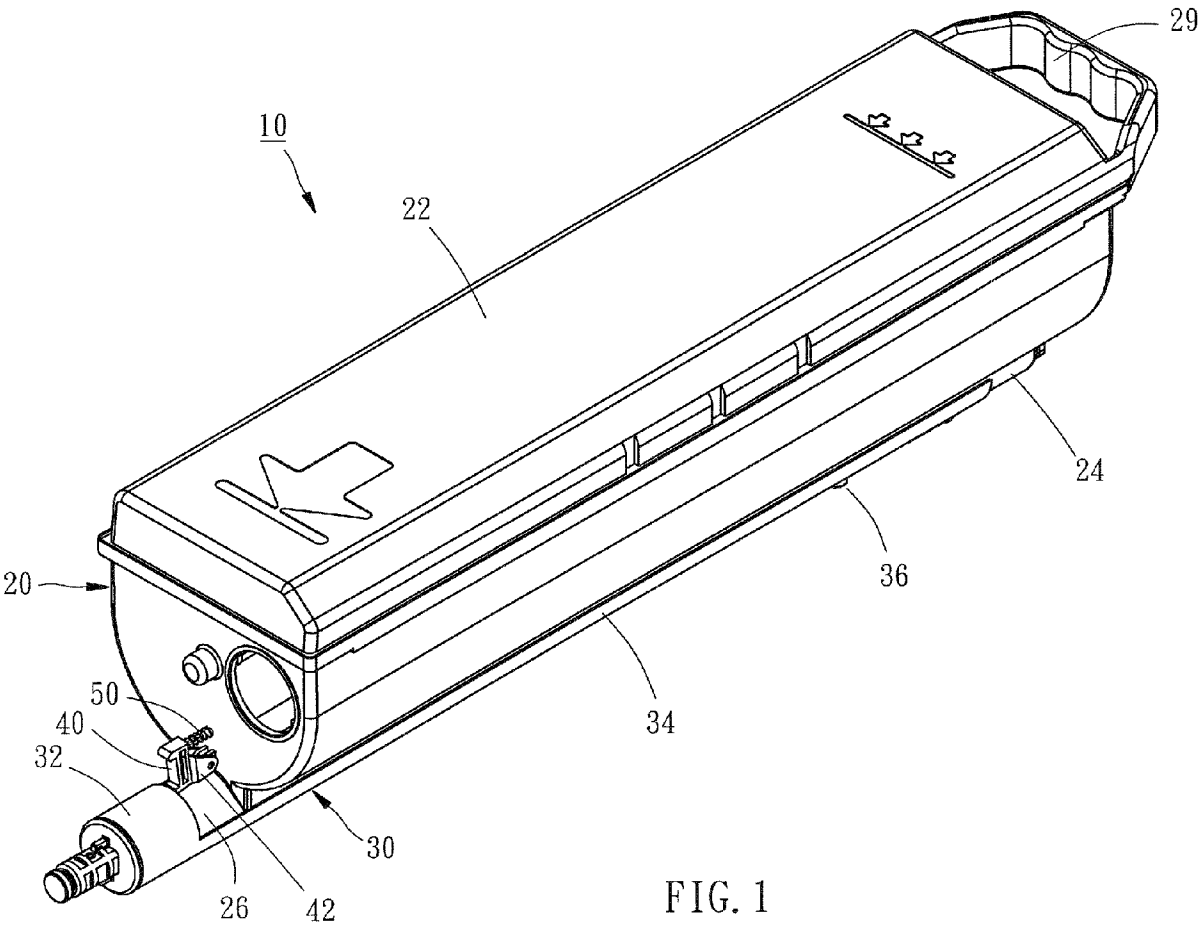
FIG. 1 is a perspective view of a first embodiment of the present invention.
Figure 2:
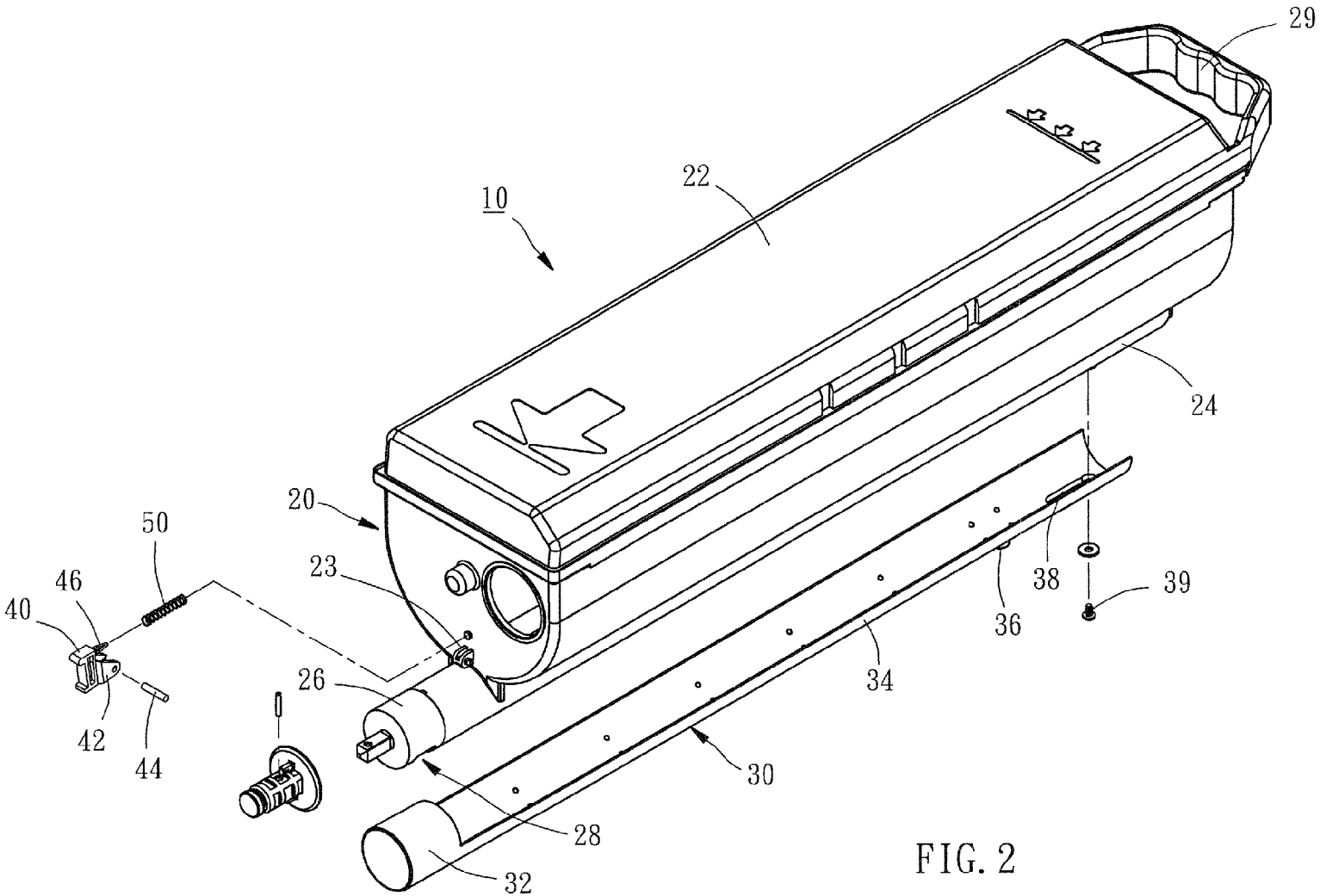
FIG. 2 is an exploded view of a first embodiment of the present invention.

As shown in FIG. 1, a toner cartridge 10 in accordance with a first embodiment of the present invention comprises a casing 20, a sliding member 30, a retaining member 40 and a spring member 50.

The casing 20 is provided with an elongated hollow main body 22 for accommodation of toner, a lug 23 on a front end of the main body 22, a guiding groove 24 formed on a bottom side of the main body 22, a tube 26 extending from the guiding groove 24 along an axial direction of the guiding groove 24, two outlets 28 formed on a bottom side of the tube 26, and a handle 29 fastened to a rear end of the main body 22 for holding by a user.

Figure 3:
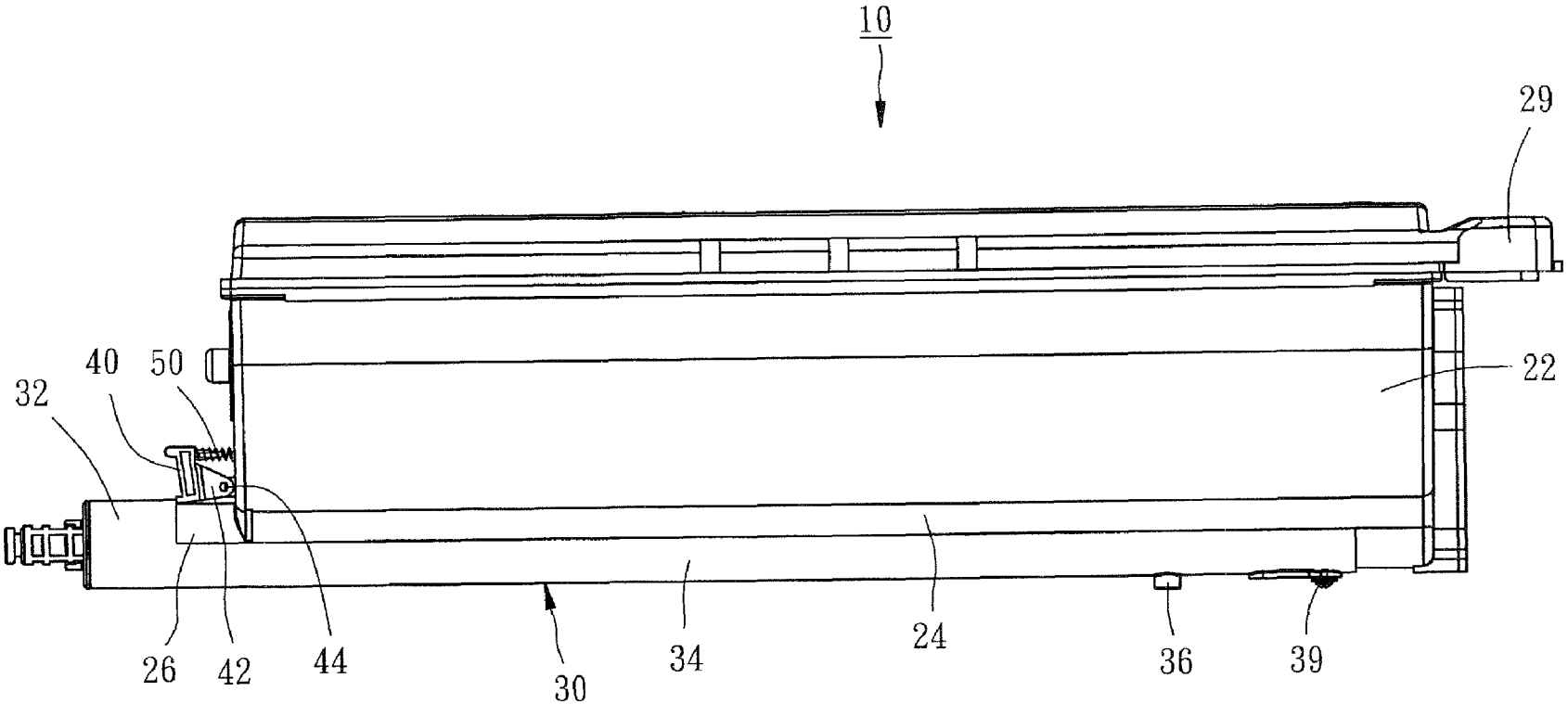
FIG. 3 is a lateral view of a first embodiment of the present invention.
Figure 4:
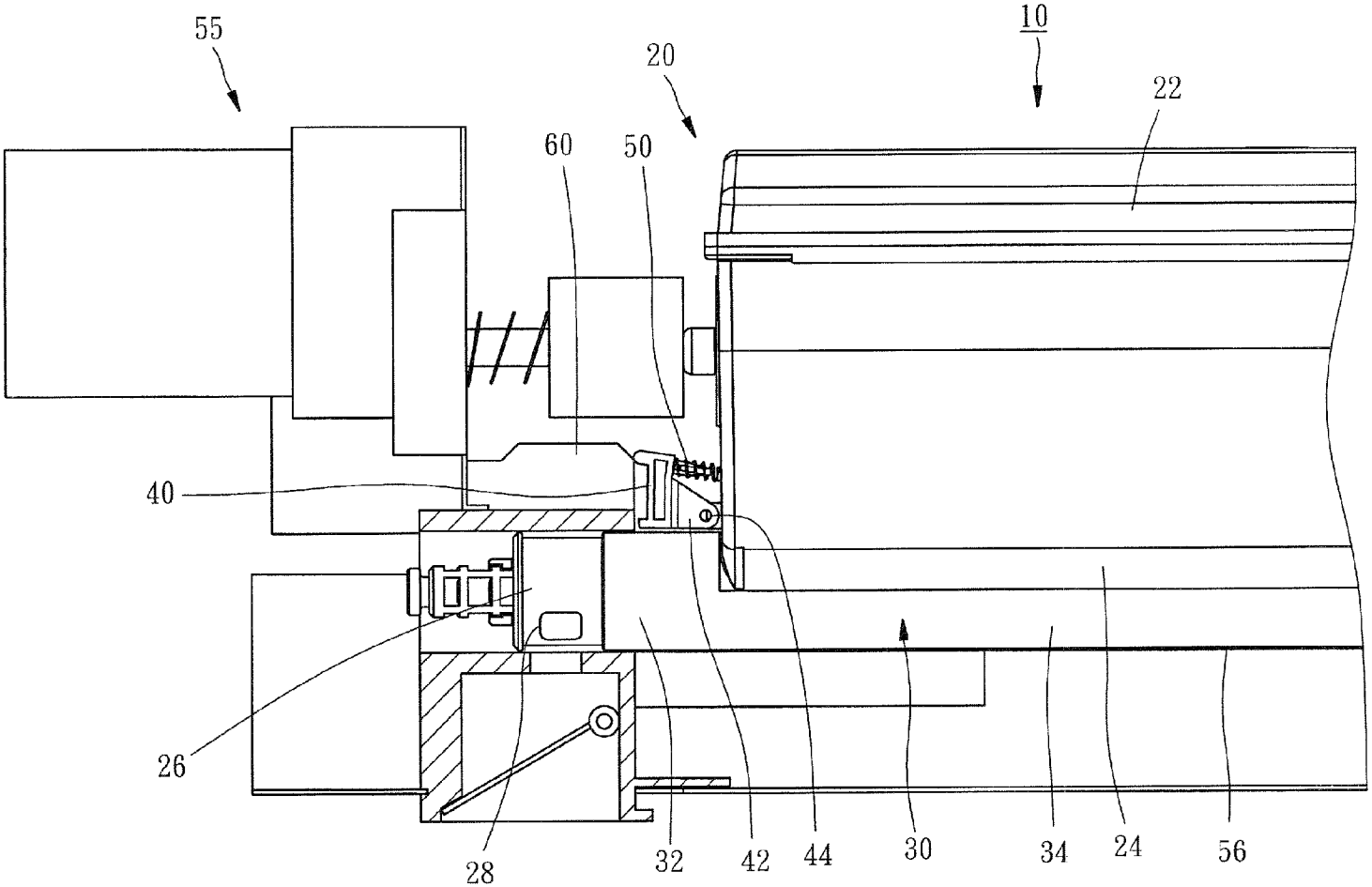
FIG. 4 is a schematic view of a first embodiment of the present invention showing that the retaining member is pivoted to the fourth position and the sliding member is moved to the second position.

The sliding member 30 is provided with a barrel 32 sleeved onto the tube 26 of the casing 20, an arc plate 34 extending backward from the barrel 32 and abutted against a periphery of the guiding groove 24 of the casing 20, a positioning pillar 36 extending downward from a bottom side of the arc plate 34, and an elongated slot 38 formed on a rear part of the arc plate 34. The sliding member 30 and the casing 20 are slidably coupled to each other by a screw 39 which is inserted through the slot 38 and threaded into the casing 20, and therefore the sliding member 30 is movable relative to the casing 20 between a first position, as shown in FIG. 3, where the outlets 28 of the casing 20 are closed by the sliding member 30 and a second position, as shown in FIG. 4, where the outlets 28 of the casing 20 are opened, i.e. the outlets 28 are not blocked by the barrel 32 of the sliding member 30.

The retaining member 40 is provided with two spaced walls 42 for installation of the lug 23 therebetween, and a pivot 44 inserted through the lug 23 and the two spaced walls 42 such that the retaining member 40 is pivotally mounted on the casing 20. Thus, the retaining member 40 is pivotable relative to the casing 20 between a third position, as shown in FIG. 3, where the retaining member 40 is engaged with the barrel 32 of the sliding member 30 to lock the sliding member 30 in the first position, and a forth position where the retaining member 40 is separated away from the barrel 32 of the sliding member 30 such that the sliding member 30 won't be restricted by the retaining member 40 and will be movable to the second position, as shown in FIG. 4. The retaining member 40 further has an arm 46.

The spring member 50 is sleeved onto the arm 46 of the retaining member 40, having two distal ends respectively stopped at the front end of the main body 22 of the casing 20 and the retaining member 40 to press the retaining member 40 to locate at the third position.

When the toner cartridge 10 is not in use or is in carrying, the retaining member 40 is pressed by the spring member 50 to locate at the third position, so that the sliding member 30 cannot move due to the restriction by the retaining member 40, i.e. the sliding member 30 is locked and the outlets 28 are closed. Under this circumstance, even though the user unintentionally touches the sliding member 30, the toner will not be leaked out. Further, when the toner cartridge 10 is inserted into a predetermined position of a photocopier 55, the friction between the sliding member 30 and a housing 56 of the photocopier 55 won't cause the sliding member 30 to move, thereby preventing the leakage of the toner. Thus, the toner cartridge 10 of the present invention can effectively improve the defects of the prior art toner cartridge to accomplish the objectives of the present invention.

In addition, when the toner cartridge 10 is inserted into the predetermined position of the photocopier 55, as shown in FIG. 3, the retaining member 40 is contacted and pushed by a mating part 60 to pivot clockwise to the forth position, such that the sliding member 30 is unrestricted and movable. As a result, the sliding member 30 can be driven to move by a positioning mechanism (not shown) of the photocopier through the positioning pillar 36. Furthermore, the present invention uses the retaining member 40 to lock or unlock the sliding member 30, so that the sliding member 30 can be designed to be slidably mounted on the casing 20 with less friction, and therefore the sliding member 30 can be easily driven by the positioning mechanism to move smoothly relative to the casing 20, thereby achieving the objective of the present invention.

Figure 6:
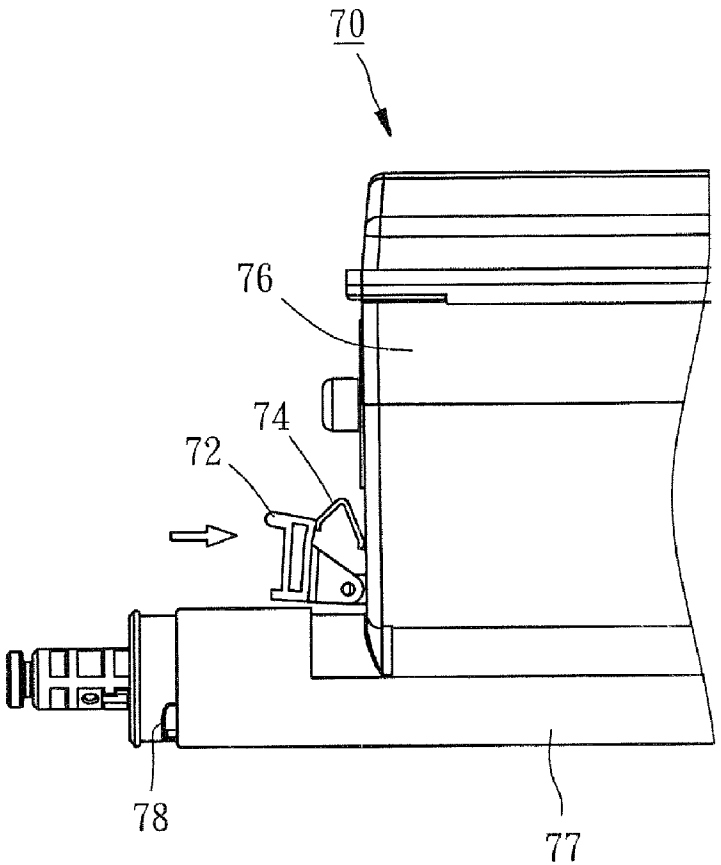
FIG. 6 is a schematic view of a second embodiment of the present invention showing that the retaining member is moved to the fourth position and sliding member is moved to open the outlet.
Figure 5:
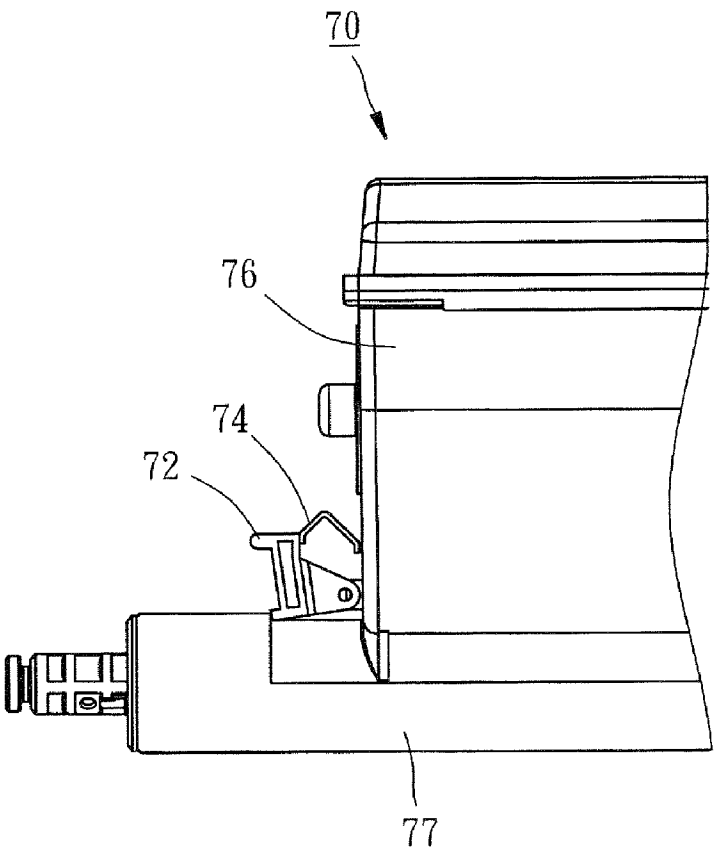
FIG. 5 is a lateral view of a second embodiment of the present invention.

The toner cartridge can be made with various kinds of design on the basis of the spirit of the present invention. For example, the shape of the retaining member and the kind of the spring member are not limited to the above-mentioned embodiment, even the spring member can be eliminated. FIG. 5 and FIG. 6 show a toner cartridge 70 in accordance with a second embodiment of the present invention. The retaining member 72 of this embodiment is integrally provided with an elastic arm 74 having a distal end stopped against the casing 76, so that the retaining member 72 is biased by the elastic force generated from the elastic arm 74 to locate at the third position, thereby locking the sliding member in the first position, as shown in FIG. 5. When the retaining member 72 is pivoted to the forth position by an external force as the arrow denoted in FIG. 6, the elastic arm 74 is bent by the external force, so that the sliding member 77 can be moved to make the outlets 78 open.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge comprising:

a casing having an outlet;

a sliding member slidably mounted on a bottom side of the casing and movable between a first position where the outlet is closed by the sliding member and a second position where the outlet is opened; and a retaining member pivotally mounted on the casing and pivotable between a third position where the retaining member is engaged with the sliding member to lock the sliding member in the first position and a fourth position where the retaining member is disengaged from the sliding member such that the sliding member is movable.

2. The toner cartridge as claimed in claim 1, wherein the casing includes a main body, a guiding groove formed on a bottom side of the main body, and a tube extending from the guiding groove and having a bottom side on which the outlet is formed.

3. The toner cartridge as claimed in claim 2, wherein the sliding member includes a barrel sleeved onto the tube of the casing, and an arc plate extending from the barrel and abutted against a periphery of the guiding groove of the casing.

4. The toner cartridge as claimed in claim 1, wherein the casing includes a lug and the retaining member includes two spaced walls for installation of the lug therebetween and a pivot inserted through the lug and the two spaced walls such that the retaining member is pivotally mounted on the casing.

5. The toner cartridge as claimed in claim 1, further comprising a spring member having two distal ends respectively stopped against the casing and the retaining member to hold the retaining member at the third position.

6. The toner cartridge as claimed in claim 5, wherein the retaining member comprises an arm onto which the spring member is sleeved.

7. The toner cartridge as claimed in claim 1, wherein the retaining member includes an elastic arm having a distal end stopped against the casing.

8. The toner cartridge as claimed in claim 1, wherein in the fourth position the sliding member is movable independently from the retaining member.

9. The toner cartridge as claimed in claim 2, wherein in the main body is configured to accommodate toner.

10. The toner cartridge as claimed in claim 1, wherein said sliding member is movable between the first and second positions when said cartridge is in use.

* * * * *